US011499498B2

(12) United States Patent
Kuromasa et al.

(10) Patent No.: US 11,499,498 B2
(45) Date of Patent: Nov. 15, 2022

(54) CYLINDER LINER AND MANUFACTURING METHOD FOR SAME

(71) Applicants: TPR CO., LTD., Tokyo (JP); TPR INDUSTRY CO., LTD., Sagae (JP)

(72) Inventors: Yuki Kuromasa, Sagae (JP); Koichi Hatakeyama, Sagae (JP); Takashi Ozawa, Tokyo (JP)

(73) Assignees: TPR CO., LTD., Tokyo (JP); TPR INDUSTRY CO., LTD., Yamagata (JP)

( * ) Notice: Subject to any disclaimer, the term of this patent is extended or adjusted under 35 U.S.C. 154(b) by 0 days.

(21) Appl. No.: 17/296,877

(22) PCT Filed: Jul. 23, 2019

(86) PCT No.: PCT/JP2019/028782
§ 371 (c)(1),
(2) Date: May 25, 2021

(87) PCT Pub. No.: WO2020/110366
PCT Pub. Date: Jun. 4, 2020

(65) Prior Publication Data

US 2022/0025829 A1 Jan. 27, 2022

(30) Foreign Application Priority Data

Nov. 28, 2018 (JP) ..... JP2018-222727

(51) Int. Cl.
*B24B 33/02* (2006.01)
*F02F 1/00* (2006.01)
(Continued)

(52) U.S. Cl.
CPC ..... *F02F 1/004* (2013.01); *B24B 33/02* (2013.01); *C22C 33/08* (2013.01); *C22C 37/00* (2013.01); *F02F 1/20* (2013.01)

(58) Field of Classification Search
CPC ..... B24B 33/02
See application file for complete search history.

(56) References Cited

U.S. PATENT DOCUMENTS

| | | | |
|---|---|---|---|
| 4,678,738 | A | 7/1987 | Shimizu et al. |
| 6,220,214 | B1 | 4/2001 | Kojima et al. |
| 2016/0303773 | A1 | 10/2016 | Sugimoto et al. |

FOREIGN PATENT DOCUMENTS

| | | |
|---|---|---|
| CN | 1415848 | 5/2003 |
| CN | 201461116 | 5/2010 |

(Continued)

OTHER PUBLICATIONS

International Search Report for PCT/JP2019/028782, dated Oct. 8, 2019.

(Continued)

*Primary Examiner* — Christopher S Kessler
(74) *Attorney, Agent, or Firm* — Nixon Peabody LLP; Jeffrey L. Costellia

(57) ABSTRACT

A cylinder liner of the present invention is a cylinder liner mounted on a cylinder block and formed of flaky graphite cast iron, at least a nitrided layer is provided on an inner periphery of the cylinder liner, and a cross hatching section is formed on the inner periphery, a roughness curve of the inner periphery has a plateau honing shape, a ten-point average roughness Rz of the inner periphery pursuant to JIS B0601:1982 is 4.0 μm or less, and an average value of an area ratio of pits generated in the inner periphery is 8% or less.

19 Claims, 13 Drawing Sheets

(51) Int. Cl.

| | |
|---|---|
| ***C22C 33/08*** | (2006.01) |
| ***C22C 37/00*** | (2006.01) |
| ***F02F 1/20*** | (2006.01) |

(56) References Cited

FOREIGN PATENT DOCUMENTS

| | | |
|---|---|---|
| CN | 10778959 | 7/2010 |
| CN | 103667861 | 3/2014 |
| CN | 106555697 | 4/2017 |
| CN | 108026616 | 5/2018 |
| CN | 108747798 | 11/2018 |
| EP | 0424109 | 4/1991 |
| JP | 60-044112 | 10/1985 |
| JP | 61-171964 | 8/1986 |
| JP | 03-134252 | 6/1991 |
| JP | 04-258572 | 9/1992 |
| JP | 06-067836 | 9/1994 |
| JP | 2000-283291 | 10/2000 |
| JP | 2002-364455 | 12/2002 |
| JP | 2008-019718 | 1/2008 |
| JP | 2016-205159 | 12/2016 |
| RU | 2252854 | 5/2005 |
| RU | 2482951 | 5/2013 |
| WO | WO-2014-065156 | 5/2014 |

OTHER PUBLICATIONS

Chinese Office Action for 201911145749.4, dated Nov. 18, 2020.
Decision to Grant a Patent for Invention in Russian Application No. 2021 118035, dated Dec. 14, 2021 (20 pages).

CYLINDER LINER AND MANUFACTURING METHOD FOR SAME

TECHNICAL FIELD

The present invention relates to a cylinder liner having a nitrided layer on an inner periphery, and a method of manufacturing the same.

Priority is claimed on Japanese Patent Application No. 2018-222727, filed Nov. 28, 2018, the content of which is incorporated herein by reference.

BACKGROUND ART

In a cylinder block of an internal combustion engine, a structure in which a cylinder liner formed of cast iron is fitted thereinto is known.

In general, various surface treatments are performed on an inner periphery of the cylinder liner to improve initial conformability performance and improve abrasion resistance and seizure resistance, and properties such as surface roughness or the like of the inner periphery are controlled.

Patent Literature 1 discloses an internal finishing method of a cylinder liner characterized in that, after finishing an inner surface of a cylinder liner formed of cast iron to be processed to a surface roughness of 2 to 6μ with oil pockets everywhere by honing, soft nitriding is applied to form a compound layer on the entire surface except the oil pockets, and then, the compound layer is honed again and the surface is adjusted such that the surface roughness is 2μ or less, and thus, a scuff resistance and an abrasion resistance of the cylinder liner are improved. Here, an average thickness of the compound layer is 4 to 5 μm. Further, the surface roughness is based on a ten-point average roughness Rz pursuant to JIS B0601:1982.

Patent Literature 2 discloses a cylinder liner characterized in that, in the cylinder liner fixed to a cylinder inner wall and on which a piston slides along an inner periphery thereof, a roughness of the inner periphery is 0.4 to 0.8 μm $R_{3Z}$, and an open graphite ratio of the inner periphery is 80% or more, and the cylinder liner can simultaneously satisfy having a low oil consumption and a high scuff resistance performance. Further, $R_{3Z}$ indicates a surface measurement quantity. In an average surface roughness Rz defined in DIN 4768, an average value of distances between a maximum peak and the deepest hole sections in five measurement cross sections is obtained, while $R_{3Z}$ is a so-called functional surface roughness, and obtained as an average at two places which are the upper end part and the lower end part. A honing finishing grinding wheel used in honing when the cylinder liner is manufactured is a fibrous elastic honing finishing grinding wheel, and a roughness of the honing grinding wheel is equal to that of GC3000L or a mixture of GC3000L and ALS2000. It is possible to perform superfinishing honing with an open graphite ratio of an inner periphery of 80% or more, which suppresses occurrence of a processing flow of the surface by using this honing grinding wheel.

CITATION LIST

Patent Literature

[Patent Literature 1] Japanese Patent Publication No. S60-044112 (B)

[Patent Literature 2] Japanese Unexamined Patent Application, First Publication No. 2000-283291 (A)

SUMMARY OF INVENTION

Technical Problem

In an internal combustion engine, further improvement in performance is required to comply with environmental regulations, and in addition to reduction in oil consumption and reduction in friction (mechanical friction loss), it is desired to provide a cylinder liner that does not cause scuffing (scratching caused by running out of oil).

In the related art, a cylinder liner (also referred to as an inner periphery nitrided liner) is known for the purpose of forming a nitrided layer on at least the inner periphery and improving an abrasion resistance and a scuff resistance. For the inner periphery of the inner periphery nitrided liner, from the viewpoint of ensuring a good lubricating environment of a sliding surface, a cross hatching section is formed through finishing honing. However, as a result, there is a problem that minute concave sections (these are referred to as pits) in which a size of an opening section in the outermost surface of the inner periphery corresponds to a diameter of about 10 to 100 μm and a depth is greater than a valley bottom of a surface roughness and is about 1.5 μm or more occur irregularly.

Since the pits generated in the inner periphery of the inner periphery nitrided liner become an oil reservoir, when occurrence of pits is irregular and the number of pits generated is large, the desired oil consumption performance cannot be obtained. For this reason, it is important to control the properties before and after nitriding on the inner periphery in the inner periphery nitrided liner.

In consideration of these circumstances, the present invention is directed to providing a cylinder liner having a nitrided layer on an inner periphery with a structure capable of reducing oil consumption and decreasing a risk of scuff occurrence, and a method of manufacturing the same.

Solution to Problem (1) A cylinder liner according to an aspect of the present invention is a cylinder liner mounted on a cylinder block and formed of flaky graphite cast iron, at least a nitrided layer is provided on an inner periphery of the cylinder liner, and a cross hatching section is formed on the inner periphery, a roughness curve of the inner periphery has a plateau honing shape, a ten-point average roughness Rz of the inner periphery pursuant to JIS B0601:1982 is 4.0 μm or less, and an average value of an area ratio of pits generated in the inner periphery is 8% or less.

(2) The cylinder liner according to the aspect of the present invention may have a metal structure in which flaky free graphite is dispersed and crystallized in a cast iron matrix, some of the free graphite present in an outermost surface part of the inner periphery of the cylinder liner may be dispersed such that a part of some of the free graphite reaches to the inner periphery as an exposed part, and the other free graphite present in the surface part of the inner periphery may extend to a vicinity of the inner periphery and is dispersed such that a part reaching the inner periphery from an extension part tip of the other free graphite is a covering section covered with a material that constitutes the cast iron matrix.

(3) In the metal structure of the outermost surface part of the cylinder liner inner periphery according to the aspect of the present invention, the number of graphite flakes in which the free graphite is exposed on the inner periphery may be referred to as a number of open graphite flakes, the number of graphite flakes in which the free graphite is not exposed on the inner periphery may be referred to as a number of closed graphite flakes, the number of open graphite flakes and the number of closed graphite flakes may be counted, and an average value of an open graphite ratio expressed by the number of open graphite flakes/(the number of open graphite flakes+the number of closed graphite flakes) may be 50% or less.

(4) A groove of the cross hatching section in the cylinder liner inner periphery according to the aspect of the present invention may be 3° to 60° of an angle opening in a direction perpendicular to an axial direction of the cylinder liner.

(5) In a method of manufacturing a cylinder liner according to an aspect of the present invention in which a cylinder liner having a cylindrical shape and formed of flaky graphite cast iron is cast, a process in forming a cylinder liner inner periphery includes undergoing a first honing process of making an inner diameter of the inner periphery close to that for finishing after cutting, in a second honing process using a grinding wheel two-stage expansion method provided with a first expansion grinding wheel and a second expansion grinding wheel, a surface roughness of the inner periphery being made to have a ten-point average roughness Rz of 1.6 μm or less and a maximum height Rmax of 2.6 μm or less, and a roughness curve being made to have a plateau honing shape, undergoing a nitriding process, and after a finishing honing process, the cylinder liner in which the roughness curve of the inner periphery has the plateau honing shape, the ten-point average roughness Rz of the inner periphery pursuant to JIS B0601:1982 is 4.0 μm or less, and an average value of an area ratio of pits generated in the inner periphery is 8% or less being obtained.

(6) In the method of manufacturing a cylinder liner according to the aspect of the present invention, the cylinder liner before nitriding may have a metal structure in which free graphite is dispersed and crystallized in a cast iron matrix, some of the free graphite present on a surface part of the inner periphery of the cylinder liner may be dispersed such that a part of some of the free graphite reaches to the inner periphery as an exposed part, the other free graphite present on the surface part of the inner periphery may extend to a vicinity of the inner periphery and be dispersed such that a part reaching the inner periphery from an extension part tip of the other free graphite may be a covering section covered with a material that constitutes the cast iron matrix, and in the metal structure of the surface part of the inner periphery, the number of graphite flakes in which the free graphite is exposed to the inner periphery may be referred to as a number of open graphite flakes, the number of graphite flakes in which the free graphite is not exposed to the inner periphery may be referred to as a number of closed graphite flakes, the number of open graphite flakes and the number of closed graphite flakes may be counted, and an average value of an open graphite ratio expressed by the number of open graphite flakes/(the number of open graphite flakes+the number of closed graphite flakes) may be 50% or less.

(7) In the method of manufacturing a cylinder liner according to the aspect of the present invention, the cylinder liner in which the surface part of the inner periphery is within a range of a depth of 20 μm from a surface of the inner periphery may be obtained.

Advantageous Effects of Invention

The present invention can provide a cylinder liner having a nitrided layer on an inner periphery with a structure capable of reducing a risk of scuff occurrence, in addition to reduction in oil consumption and friction, and a method of manufacturing the same.

DESCRIPTION OF EMBODIMENTS

Figure 1:
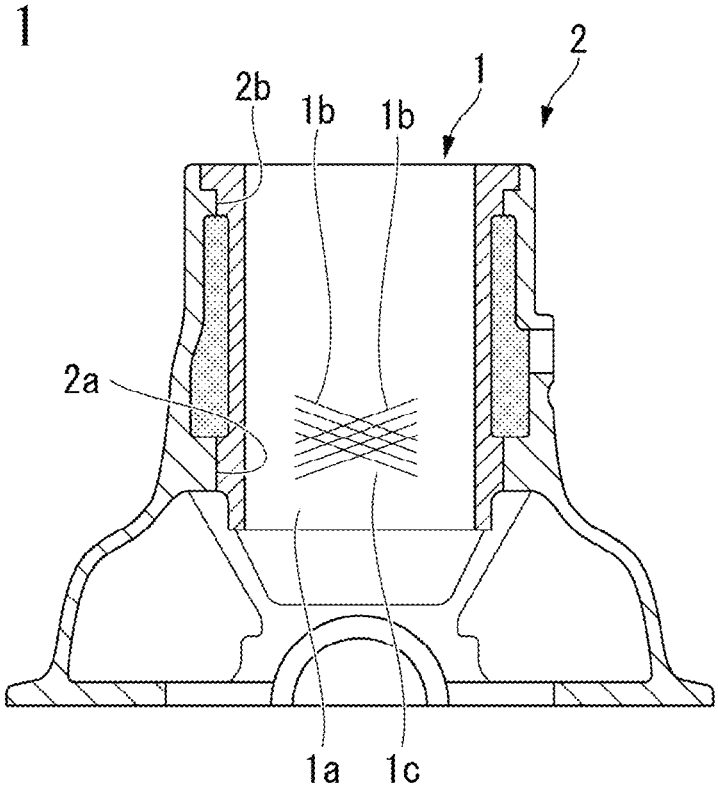
FIG. 1 is a longitudinal cross-sectional view showing a cylinder liner of an embodiment of the present invention attached to a cylinder block.

Hereinafter, an embodiment of the present invention will be described in detail. FIG. 1 shows a partial cross-sectional structure of a cylinder block 2 including a cylinder liner 1 of the embodiment according to the present invention. The cylinder block 2 is formed of a cast iron or a light alloy such as an aluminum alloy or the like, and the cylinder liner 1 is formed of flaky graphite cast iron. The cylinder liner 1 has at least an inner periphery 1*a* on which a nitrided layer is formed through gas nitriding and a cross hatching section 1*c* constituted by a groove section 1*b* is formed through further honing, and is engaged with fitting sections 2*a* and 2*b* formed on the cylinder block 2. A cooling water passage is formed between the fitting sections 2*a* and 2*b* of the cylinder block 2 in the outer periphery of the cylinder liner 1.

Figure 2:
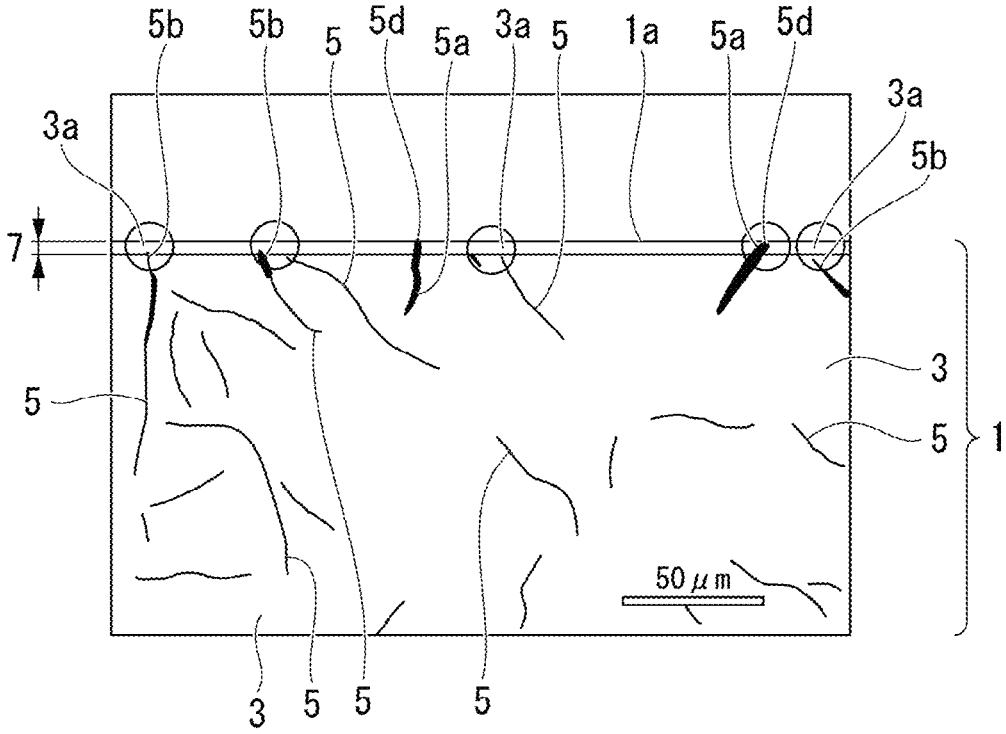
FIG. 2 is a schematic view showing an example of a metal structure of an inner periphery side cross section in the cylinder liner of the embodiment.

The flaky graphite cast iron that forms the cylinder liner 1 has a metal structure in which flaky free graphite 5 is dispersed in a plurality of flakes and crystallized in a cast iron matrix 3 formed of an iron-based alloy in a cross section perpendicular to a sliding direction of a piston ring with respect to the inner periphery 1*a* of the cylinder liner 1 as shown in FIG. 2, and a compound layer 7 is formed on an inner periphery section through nitriding.

In FIG. 2, among the free graphite 5 present in a surface part to a depth of about 20 μm from the inner periphery 1*a*, some of the free graphite 5 is dispersed such that a part 5*a* of the some of the free graphite 5 extends to reach the inner periphery 1*a* and is exposed on the inner periphery 1*a*. A part of the part 5*a* of the free graphite 5 exposed on the inner periphery 1*a* is an exposed part 5*d*.

In addition, while the other free graphite 5 present in the surface part to a depth of about 20 μm has a part 5*b* extending toward the inner periphery 1*a*, the free graphite 5 is dispersed with a slight distance (a distance of about 10 μm or less) between the inner periphery 1*a* and the part 5*b* without the part 5*b* closest to the inner periphery 1*a* reaching the inner periphery 1*a*. That is, while the other free graphite 5 present on the surface part has the part 5*b* extending to the vicinity of the inner periphery 1*a*, a covering section 3*a* formed of a material that constitutes the cast iron matrix 3 is provided.

Figure 3A:
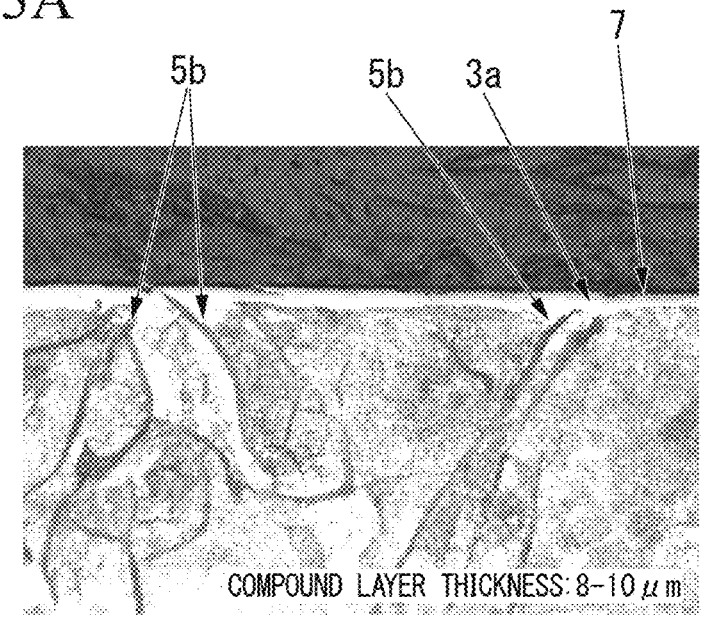
FIG. 3A is a view showing a metal structure and a compound layer (a white layer in a surface) by a metallurgical microscope photograph (400 times) of the inner periphery side cross section in the cylinder liner after finishing honing, in particular, showing a state in which a free graphite is not exposed to a surface part of the inner periphery.
Figure 3B:
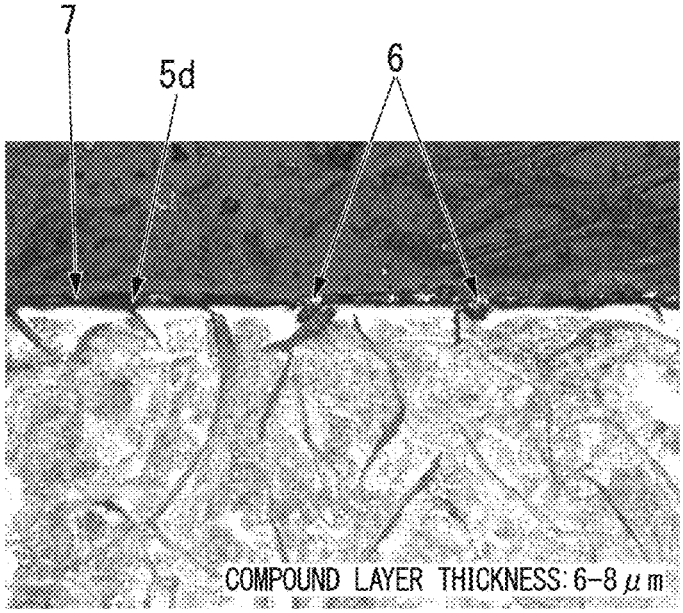
FIG. 3B is a view showing a metal structure and a compound layer (a white layer in a surface) by a metallurgical microscope photograph (400 times) of the inner periphery side cross section in the cylinder liner after finishing honing, in particular, showing a state in which a large amount of free graphite is exposed to the surface part of the inner periphery and the pits are occurred.

FIGS. 3A and 3B show the metal structure and the compound layer 7 (a white layer in a surface) by a metallurgical microscope of 400 times after finishing honing of the inner periphery side cross section in the cylinder liner. In FIG. 3A, the part of the free graphite reaching the inner periphery is covered with the material that constitutes the cast iron matrix, and the free graphite is not exposed to the surface part of the inner periphery. In FIG. 3B, a large amount of free graphite is exposed to the surface part of the inner periphery. In addition, pits 6 are generated. A thickness of the compound layer 7 (a white layer) is 8 to 10 μm in FIG. 3A and 6 to 8 μm in FIG. 3B.

The inner periphery 1*a* of the cylinder liner 1 is a surface on which a piston ring (not shown) and a piston (not shown) reciprocate. Accordingly, after gas nitriding, a weak porous layer present on the surface part and formed through nitriding is removed, and finishing honing is performed to form an appropriate surface as a sliding surface. A roughness curve has a plateau honing shape with a smooth mountain section, and a ten-point average roughness Rz pursuant to JIS B0601: 1982 is preferably 4.0 μm or less. The ten-point average roughness Rz is preferably 1.5 μm or more and 4.0 μm or less.

As shown in FIG. 1, the cross hatching section 1*c* constituted by the pair of groove sections 1*b* that form an angle of about 30° (referred to as a cross hatching angle) opening in a direction perpendicular to the axial direction of the cylinder liner 1 is formed on the inner periphery 1*a* of the cylinder liner 1 through finishing honing. Further, the cross hatching angle is not limited to 30°, and an arbitrary angle can be selected within a range of about 3° to 60°.

In the cross section of the inner periphery that forms appropriate surface properties as a sliding surface through finishing honing, a predetermined nitrided layer is provided.

It is preferable that the nitrided layer is formed from a nitrided compound layer (the compound layer 7) and a nitrogen diffusion layer in this order from the side of the outermost surface of the cylinder liner inner periphery 1*a*, and is a region of a metal structure in which cross section hardness has a micro-Vickers hardness of 350 HV 0.05 or more, a thickness of the compound layer 7 is 3 μm or more from the inner periphery, and a thickness of the nitrogen diffusion layer is 40 μm or more from the inner periphery. Hereinafter, the micro-Vickers hardness is pursuant to JIS Z 2244: 2009. 0.05 indicates a pressing force (Kgf) of a rectangular pyramidal penetrator attached to the specimen.

A thickness of the compound layer 7 is preferably 15 μm or less from the inner periphery. When exceeding this, an opening area of the pits 6 is increased, and the depth also becomes deeper. A thickness of the compound layer 7 is more preferably from 3 μm or more and 12 μm or less from the inner periphery.

<Measurement of Compound Layer>

In the compound layer 7, after fragments of the cylinder liner are buried in the resin and performed a specular finishing by abrasion, a material immersed in an etching agent of Nital etching 2% is observed by a metallurgical microscope (400 times). The compound layer 7 can be confirmed as a white layer as shown in FIGS. 3A and 3B. In addition, the compound layer 7 preferably has a micro-Vickers hardness of 700 HV 0.05 or more pursuant to JIS Z 2244: 2009. A boundary between the compound layer 7 and the nitrogen diffusion layer may be confirmed by the hardness, and the hardness may use micro-Vickers hardness. In the boundary between the compound layer 7 and the nitrogen diffusion layer, the micro-Vickers hardness pursuant to JIS Z 2244: 2009 indicates that the compound layer 7 is about 900 HmV and the nitrogen diffusion layer is about 350 HmV. Accordingly, the boundary between the compound layer 7 and the nitrogen diffusion layer can be confirmed according to a difference in hardness of the compound layer 7 and the nitrogen diffusion layer.

The thickness of the compound layer 7 is within a range from a minimum value to a maximum value of arbitrary 4 places obtained by preparing fragments from the arbitrary 4 places of each of the cylinder liner inner peripheries 1*a* and measuring the range of the thickness of the compound layer 7 using a metallurgical microscope. Hereinafter, the arbitrary 4 places of the cylinder liner inner peripheries are total 4 places of 2 places facing in a radial direction of a central position and 2 places facing in the radial direction of arbitrary positions of 20 to 50 mm from the cylinder liner end surface in the axial direction of the cylinder liner. However, it is assumed that two radial directions are in an orthogonal positional relationship. The thickness of the nitrogen diffusion layer may be within a range to reach the hardness (about 300 HmV) of the base material of the cast iron matrix 3 on the side of the cast iron matrix 3 from the boundary between the compound layer 7 and the nitrogen diffusion layer in the fragments using thickness measurement of the compound layer 7.

Figure 4A:
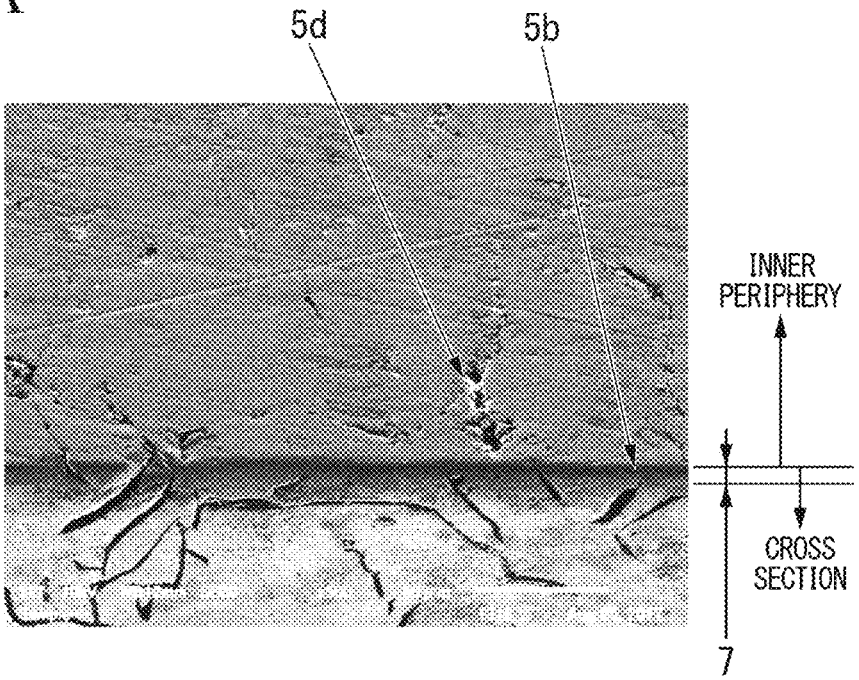
FIG. 4A is a view showing an example of Example 2 of a SEM image (500 times) after finishing honing, in which an inner periphery and a cross section in the cylinder liner are simultaneously photographed.
Figure 4B:
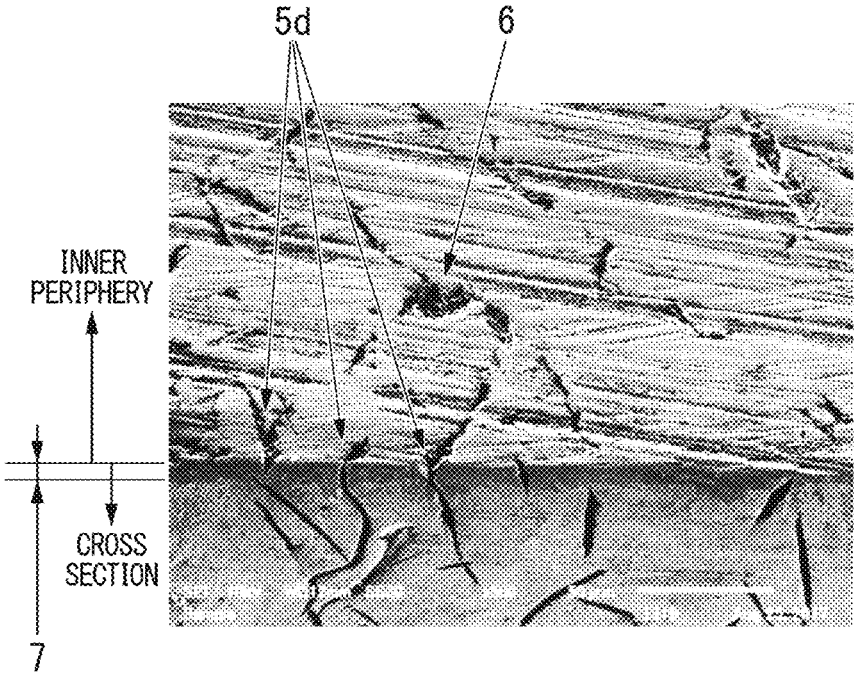
FIG. 4B is a view showing an example of Comparative example 1 of a SEM image (500 times) after finishing honing, in which the inner periphery and the cross section in the cylinder liner are simultaneously photographed.

FIGS. 4A and 4B show SEM images of 500 times obtained by simultaneously photographing the inner periphery 1*a* and the metal structure of the cross section.

In FIG. 4A, exposure of the free graphite to the inner periphery is small, and in FIG. 4B, exposure of the free graphite to the inner periphery can be observed largely, and presence of the pits 6 can be confirmed.

A mechanism in which the pits 6 are generated in the inner periphery 1*a* of the inner periphery nitrided liner will be described.

When the cross hatching section is formed on the surface of the nitrided layer by performing finishing honing on the inner periphery after nitriding of the cylinder liner, since the base of the cylinder liner inner periphery is risen by nitriding around the exposed part in the inner periphery of the free graphite that is not nitride and the base forms the compound layer 7 that is hard and brittle, a grinding wheel expansion force of the finishing honing is concentrated to the risen base. As a result, the base part consisting of the compound layer 7 is missing or the graphite is dropped at the same time, and the pits 6 are generated. Accordingly, the depth of the pits 6 is considered to be equal to or smaller than the thickness of the compound layer 7. A size of the opening section of the pit 6 in the cylinder liner inner periphery 1*a* corresponds to a diameter of about 10 to 100 μm as shown in FIGS. 5A, 5B and 5C.

Figure 5A:
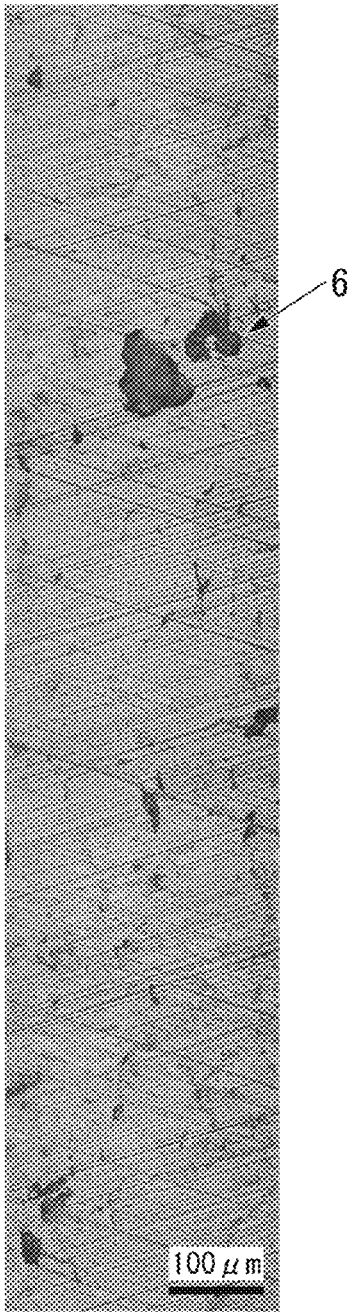
FIG. 5A is a laser microscope photograph (1000 times) in the cylinder liner inner periphery and a view showing a state before image processing of measuring an area ratio of pits.
Figure 5B:
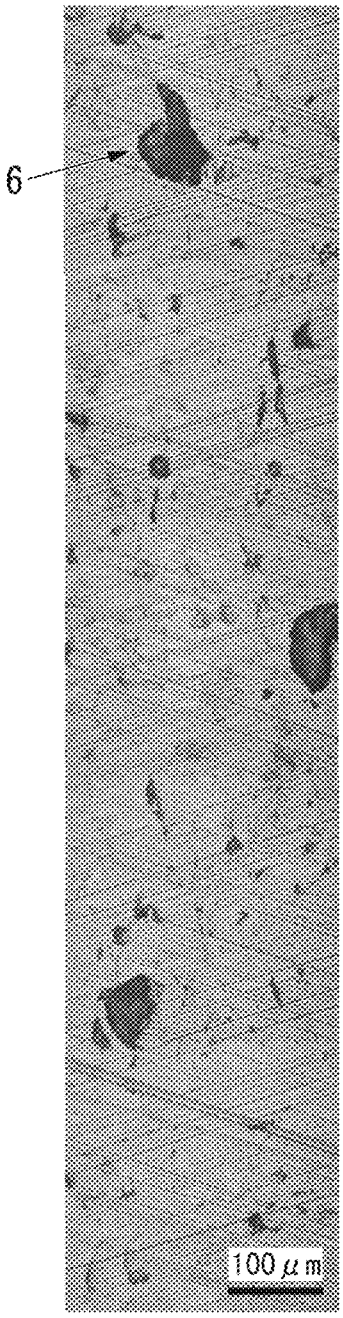
FIG. 5B is a laser microscope photograph (1000 times) in the cylinder liner inner periphery and a view showing a state before image processing of measuring an area ratio of pits.
Figure 5C:
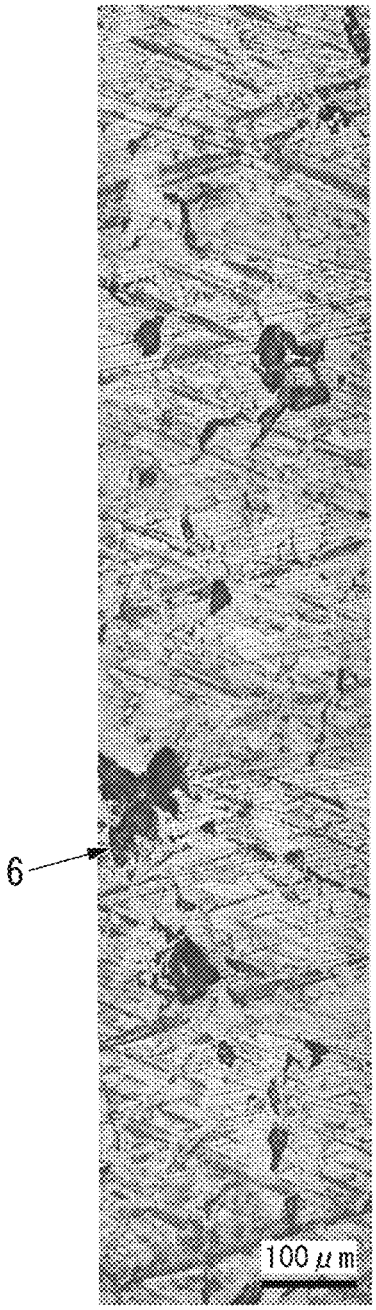
FIG. 5C is a laser microscope photograph (1000 times) in the cylinder liner inner periphery and a view showing a state before image processing of measuring an area ratio of pits.

In generation of the pits 6 as shown in FIGS. 5A, 5B and 5C, when the opening area of the pits 6 in the cylinder liner inner periphery 1*a* is increased, the amount of engine lubricant retained and stored in the pits 6 increases, and oil consumption is deteriorated because an amount of oil that evaporates from the engine lubricant increases. In addition, it is considered that the piston ring causes an increase in friction when sliding the edge of the inner periphery section of the pits 6. Further, the edge of the inner periphery section of the pit 6 is missing, which is also a risk factor for occurrence of the scuff.

For this reason, the area ratio of the pits 6 is preferably 8% or less, more preferably, 6% or less. While the area ratio of the pits 6 is preferable as it is decreased, an extremely low area ratio of the pits 6 causes an increase in risk of seizure. For this reason, the area ratio of the pits 6 is preferably 1% or more.

<Measurement of Air Ratio of Pits>

In the arbitrary 4 places of the above-mentioned cylinder liner inner peripheries la, a laser microscope captures 5 fields of vision in a row per one place with a photograph of 1000 times of the inner periphery, and an average value of the 5 fields of vision of the area ratio of the pits 6 obtained through binary processing and image analysis of the 5 fields of vision is referred to as an area ratio of the pits 6 of the one place. Further, the average value of the area ratio of the pits 6 that is an average value of each of the 4 places is referred to as an area ratio of the pits 6 in each of the cylinder liners. In measurement of the area ratio of the pits 6, a laser microscope of a model number VK-9710 manufactured by Keyence Corporation was used. The area ratio of the pits 6 in FIG. 5A is 4.0%. The area ratio of the pits 6 in FIG. 5B is 6.5%. The area ratio of the pits 6 in FIG. 5C is 12.0%.

When a mechanism in which the pits 6 are generated in the cylinder liner inner periphery 1*a* is considered, it was determined that exposure of the free graphite to the inner periphery is preferably small, and in the metal structure of the cross section of the inner periphery section before nitriding, when a plastic flow of the cast iron matrix is generated within a range of the thickness to which the compound layer 7 of the inner periphery section is formed, exposure of the free graphite to the inner periphery can be minimized.

That is, among FIGS. 4A and 4B, FIG. 4A shows a state of a preferable inner periphery. Regarding this, it is determined whether free graphite present in a depth range of about 20 μm from the inner periphery in a length range of a predetermined inner periphery is graphite 5*d* (opening graphite) that is exposed to the inner periphery or graphite (closed graphite) that is not exposed to the inner periphery including the graphite 5*b* covered with the cast iron matrix, and an open graphite ratio (%) indicating a ratio of the number of open graphite flakes with respect to a total of the number of open graphite flakes and the number of closed graphite flakes is obtained. The open graphite ratio is preferably 50% or less, more preferably 35% or less. When the open graphite ratio exceeds 50%, the area ratio of the pits 6 is increased, which is not preferable. While a lower open graphite ratio is preferable, an extremely low open graphite ratio increases the risk of seizure. For this reason, the open graphite ratio may be 5% or more.

<Measurement of Open Graphite Ratio>

In the arbitrary 4 places of the above-mentioned cylinder liner inner peripheries la, an average value of the arbitrary 4 places was obtained as an open graphite ratio by observing 5 fields of vision in a row at one place using a photograph of 400 times of a cross section structure on the side of the inner periphery by a metallurgical microscope, determining all free graphite in all of the 5 fields of vision, and calculating the open graphite ratio (%).

<Manufacturing Method>

An example of a method of manufacturing the cylinder liner 1 will be described below. The method of manufacturing the cylinder liner of the embodiment is not limited to the following manufacturing method and the cylinder liner may be manufactured according to the other inner periphery machining method or condition.

Figure 6:
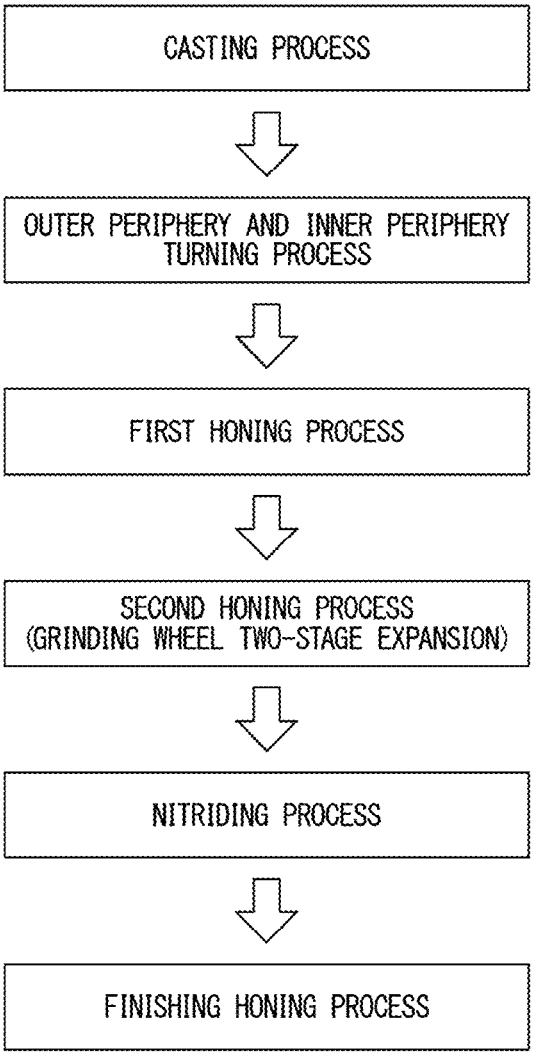
FIG. 6 is a view showing an overview of a machining process related to the cylinder liner of the embodiment of the present invention.

FIG. 6 shows an outline of a manufacturing process related to the cylinder liner of the embodiment according to the present invention. As shown in FIG. 6, a process of performing a casting process, an outer circumference and inner circumference turning process, a first honing process, a second honing process (grinding wheel two-stage expansion), a nitriding process, and a finishing honing process in sequence can be employed as an example.

A casting method of the cylinder liner 1 is not particularly limited, and a known casting method such as a sand mold casting method, a centrifugal casting method, or the like, can be used. A material that constitutes the cylinder liner of the embodiment is flaky graphite cast iron.

The material that constitutes the cylinder liner has a composition including C: 2.5% or more and 3.5% or less, Si: 1.7% or more and 2.5% or less, Mn: 0.5% or more and 1.0% or less, P: 0.1% or more and 0.5% or less, S: 0.12% or less, Cr: 0.2% or more and 0.8% or less, Cu: 0% or more and 0.6% or less, and Ni: 0% or more and 0.4% or less, in terms of mass %, and constituted by the remainder Fe and inevitable impurities, and at least one element such as B, Cu, Nb, W, or the like, may be included in the composition. While the size of the graphite is not particularly limited, for example, the size may be 4 to 6 (ISO 945-1: 2008), the type of the graphite is a type A, which is 70% or more, and the matrix of the flaky graphite cast iron may contain 5% or less of an eutectic cured phase. The hardness of the material may be 90 HRB or more and 115 HRB or less on the basis of JIS Z 2245: 2011. A cylinder liner material having a cylindrical shape with a product inner diameter or 80 to 220 mm and a product length of 80 to 450 mm is obtained.

First, coarse grinding of removing black scale such as an oxide film or the like on the inner and outer peripheries of the cylinder liner material is performed, and rough processing of the inner periphery and the outer periphery is performed. Next, the inner periphery and the outer periphery are processed to a state close to desired dimensions using an NC lathe or the like, and finishing of the outer periphery is terminated. After that, the inner periphery is processed to the inner diameter close to that of a finished product through honing (a first honing process) using a honing grinding wheel, next, accurate honing of the inner periphery according to properties of the inner periphery after nitriding is performed (a second honing process), then, finishing honing (a finishing honing process) is performed via the nitriding process, and thus, the product is fabricated.

[First Honing Process]

This is an accurate machining process that processes to an inner diameter close to the finishing as a product and creates accuracy of roundness and cylindricity of the inner periphery. The grinding wheel is metal bond bonded by a cubic boron nitride (CBN)-based grinding wheel or vitrified bonded by a silicon carbide (GC)-based grinding wheel, and in both cases, the particle size is preferably a particle size between #200 and #400. Here, two types of grinding wheels are attached to a honing head (a tool that holds the grinding wheel and expands the grinding wheel toward the cylinder liner inner periphery) of one honing machine, and following the processing of the first grinding wheel (a CBN-based grinding wheel, also referred to as a first expansion grinding wheel), the second grinding wheel (a GC-based grinding wheel, also referred to as a second expansion grinding wheel) may be sequentially expanded to perform the honing. The surface roughness of the inner periphery is appropriately 3.0 μm or less for the ten-point average roughness Rz pursuant to JIS B6010: 1982, and 3.5 μm or less for the maximum height Rmax. A roughness curve may be a single honing shape. A machining allowance of the first honing is preferably set to about 100 μm in diameter.

Hereinafter, the surface roughness is pursuant to JIS B6010: 1982.

[Second Honing Process]

This is a process that performs accurate processing in anticipation of changes in the properties of the inner periphery applied to the properties of a predetermined inner periphery after nitriding. Here, two types of grinding wheels are attached to a honing head of one honing machine, and following the processing of the first grinding wheel, honing of a grinding wheel two-stage expansion method of sequentially expanding the second grinding wheel is performed.

The first grinding wheel (also referred to as a first expansion grinding wheel) is metal bond bonded by a diamond-based grinding wheel, and the particle size is preferably a particle size that is greater than #700. The surface roughness of the inner periphery is 2.5 μm or less for the ten-point average roughness Rz and is 3.0 μm or less for a maximum height Rmax. A roughness curve may be a single honing shape.

The second grinding wheel (also referred to as a second expansion grinding wheel) is metal bond bonded by a GC-based grinding wheel, and the particle size is preferably a particle size that is greater than #1000. The surface roughness of the inner periphery is 1.6 μm or less for the ten-point average roughness Rz and is 2.6 μm or less for the maximum height Rmax. The roughness curve after processing by the second grinding wheel may have a plateau honing shape. The surface roughness of the inner periphery is preferably 0.5 μm or more and 2.0 μm or less for the ten-point average roughness Rz and 0.3 μm or more and 1.5 μm or less for the maximum height Rmax.

A total machining allowance by a first grinding wheel processing and a second grinding wheel processing in second honing is preferably set to about 20 μm in diameter.

In the second honing, the roughness curve is formed in a single honing shape by the first expansion grinding wheel, the surface roughness is decreased, then, the roughness curve is formed in a plateau honing by processing of removing a mountain section of the roughness curve formed by the first expansion grinding wheel by the second expansion grinding wheel, a plastic flow is generated on the outermost surface of the cylinder liner metal structure, and exposure of the graphite to the outermost surface of the inner periphery 1*a* is extremely minimized.

According to this effect, as shown in FIG. 2 or FIG. 3A, while some of the free graphite 5 extends the part 5*b* to the vicinity of the inner periphery 1*a*, the parts 5*b* having the covering section 3*a* covered with the material that constitutes the cast iron matrix can be expressed. Accordingly, the open graphite ratio of 50% or less is achieved.

[Nitriding Process]

After the second honing is performed, nitriding is performed.

The nitriding can be performed by, for example, heating and holding to a temperature of 560° C. to 600° C. for 30 to 90 minutes and cooling the temperature to a fixed temperature after heating in a dedicated nitriding furnace in which ammonia ($NH_3$) gas is satisfied as a reaction gas.

The entire periphery of the cylinder liner is nitrided through nitriding. In the metal structure of the inner periphery, the compound layer 7 is formed to a thickness of about 4 μm to about 20 μm from the cylinder liner surface through nitriding, and further, a nitrogen diffusion layer is formed toward the inside from the cylinder liner surface to a depth of about 50 μm or more.

Figure 7A:
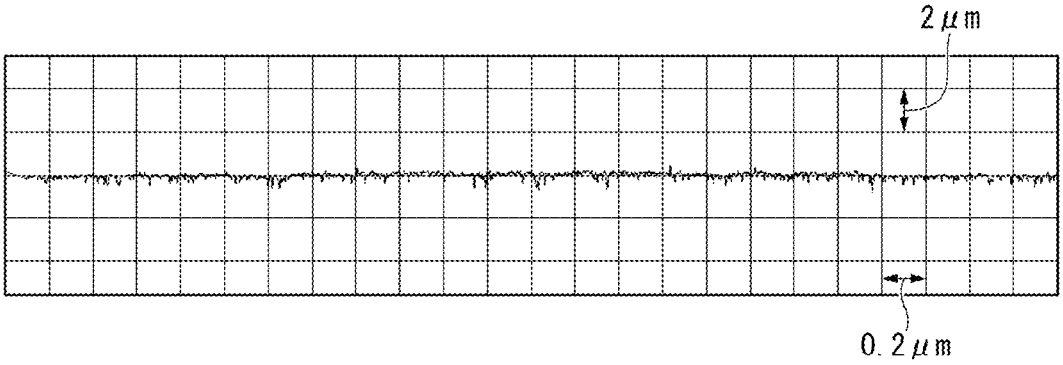
FIG. 7A is a view showing a surface roughness before nitriding (after second honing) of a cylinder liner inner periphery of Example 2.
Figure 7B:
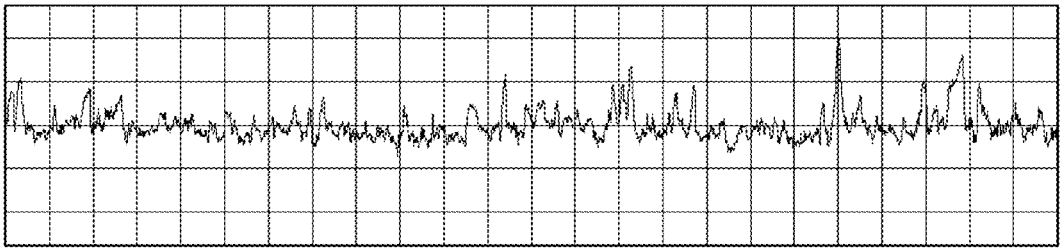
FIG. 7B is a view showing a surface roughness after nitriding of the cylinder liner inner periphery of Example 2.
Figure 7C:
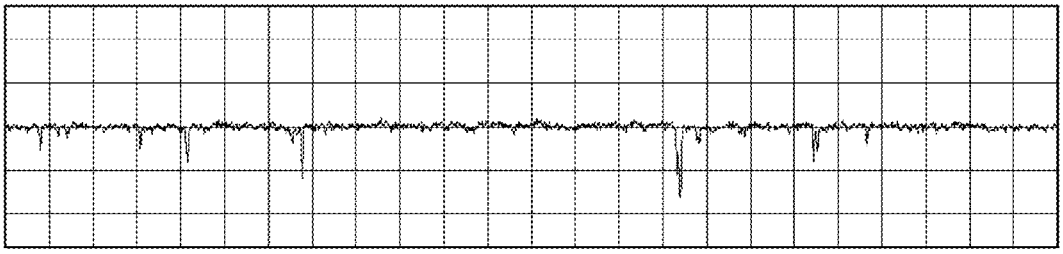
FIG. 7C is a view showing a surface roughness after finishing honing of the cylinder liner inner periphery of Example 2.
Figure 7D:
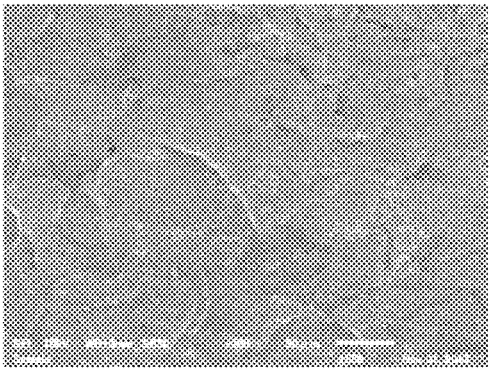
FIG. 7D is a view showing a SEM image after nitriding of the cylinder liner inner periphery of Example 2.
Figure 7E:
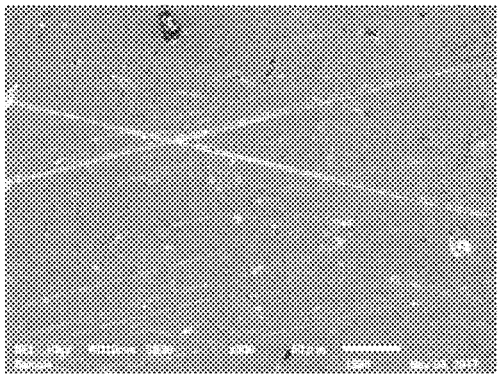
FIG. 7E is a view showing a SEM image after finishing honing of the cylinder liner inner periphery of Example 2.
Figure 8A:
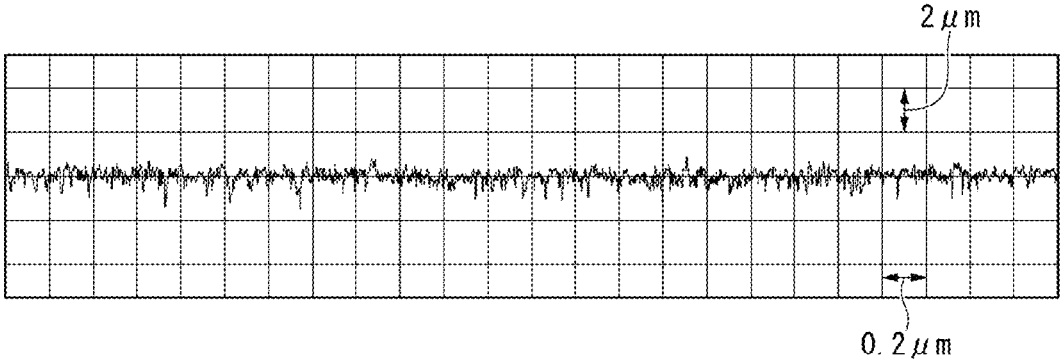
FIG. 8A is a view showing a surface roughness before nitriding (after first honing) of a cylinder liner inner periphery of Comparative example 1.
Figure 8B:
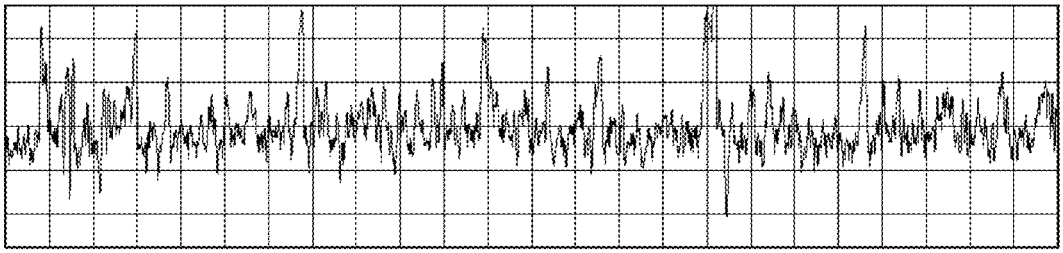
FIG. 8B is a view showing a surface roughness after nitriding of the cylinder liner inner periphery of Comparative example 1.
Figure 8C:
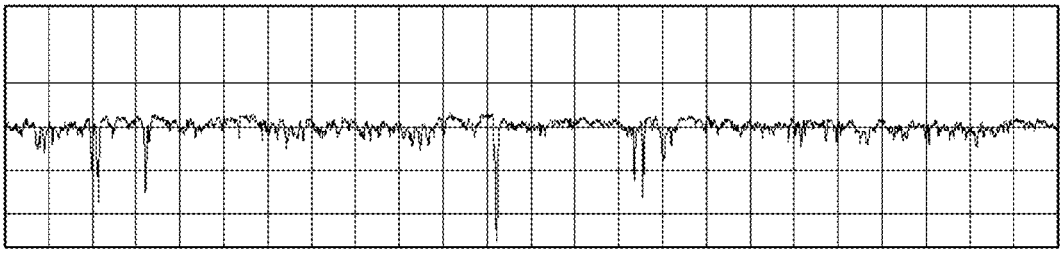
FIG. 8C is a view showing a surface roughness after finishing honing of the cylinder liner inner periphery of Comparative example 1.
Figure 8D:
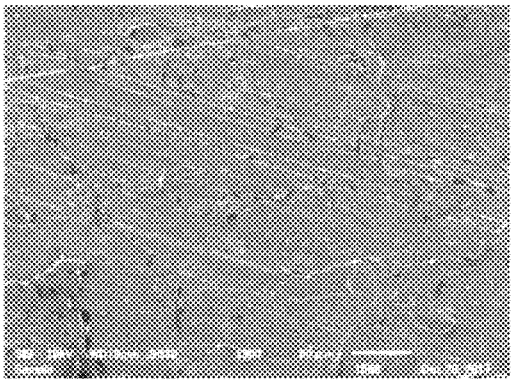
FIG. 8D is a view showing a SEM image after nitriding of the cylinder liner inner periphery of Comparative example 1.
Figure 8E:
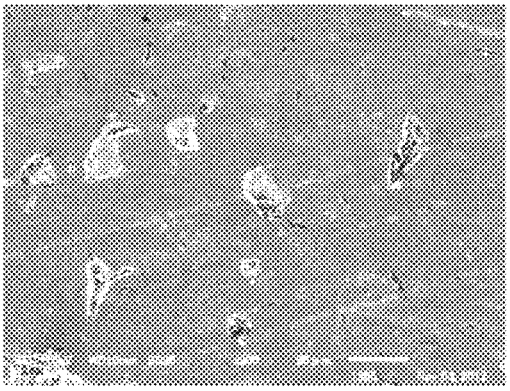
FIG. 8E is a view showing a SEM image after finishing honing of the cylinder liner inner periphery of Comparative example 1.
Figure 9A:
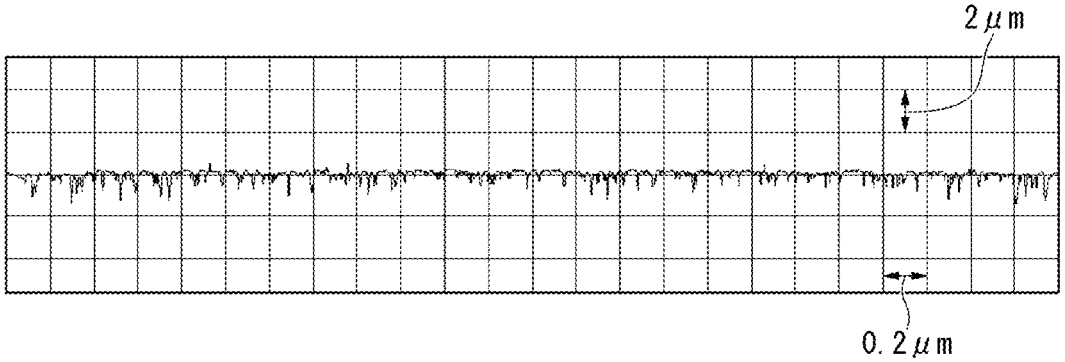
FIG. 9A is a view showing a surface roughness before nitriding (after second honing, however, only second expansion grinding wheel machining) on a cylinder liner inner periphery of Comparative Example 2.
Figure 9B:
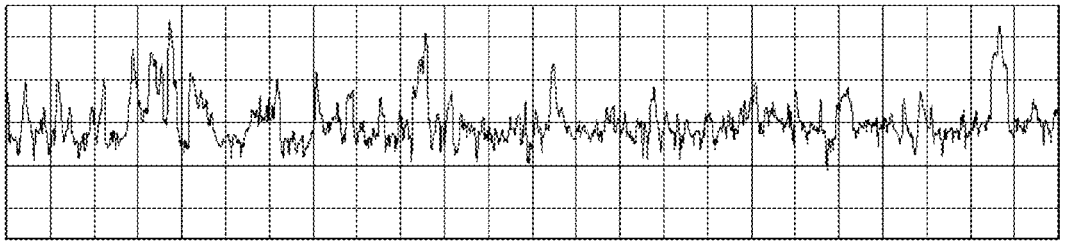
FIG. 9B is a view showing a surface roughness after nitriding of the cylinder liner inner periphery of Comparative Example 2.
Figure 9C:
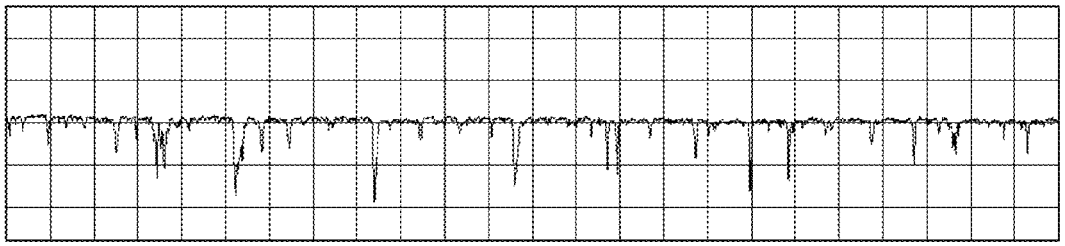
FIG. 9C is a view showing a surface roughness after finishing honing of the cylinder liner inner periphery of Comparative Example 2.
Figure 9D:
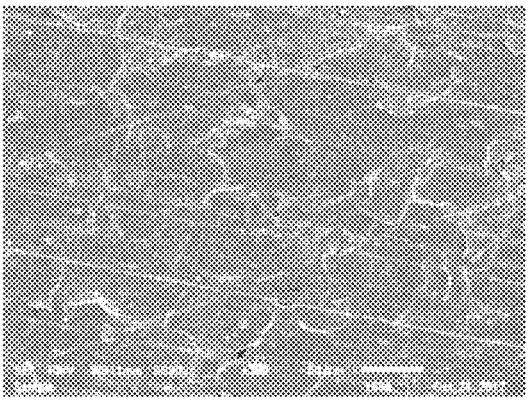
FIG. 9D is a view showing a SEM image after nitriding of the cylinder liner inner periphery of Comparative Example 2.
Figure 9E:
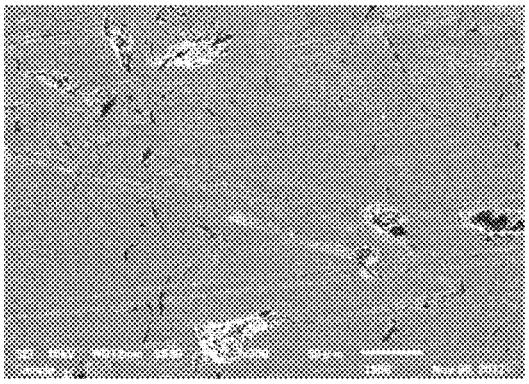
FIG. 9E is a view showing a SEM image after finishing honing of the cylinder liner inner periphery of Comparative Example 2.

In the inner periphery after nitriding, due to rising of the base of the inner periphery of the cylinder liner at the porous layer formed on the outermost surface and around the exposed part in inner periphery of the free graphite that is not nitrided, for example, as shown in FIGS. 7B, 8B and 9B, the roughness curve of the inner periphery has a shape in which a mountain section is high and a valley section is low, the ten-point average roughness Rz goes from 4 μm to 6 μm, and in comparison with the inner periphery on which the second honing is performed, the surface roughness of four times to five times is formed.

[Finishing Honing Process]

Finishing is performed on properties of a predetermined inner periphery through finishing honing.

Two types of grinding wheels are attached to a honing head of one honing machine, a first grinding wheel is electrodeposited (fixed with Ni plating) by a diamond-based grinding wheel, a particle size is a particle size that is greater than #700, a second grinding wheel is cork bonded by a GC-based grinding wheel, a particle size is a particle size that is a greater than #300, and two types grinding wheels are preferably expanded at the same time. The first grinding wheel forms a cross hatching section on the inner periphery. The second grinding wheel plays a role in forming the roughness curve in a plateau honing shape by removing the mountain section of the roughness curve using the first grinding wheel.

In the finishing honing, a weak porous layer present on the surface part of the inner periphery 1*a* of the cylinder liner and formed through nitriding is removed, the groove section 1*b* configured to secure oil retentivity is formed to form the cross hatching section 1*c*, the nitrided layer is finished such that the surface properties has a surface roughness within a desired range, for example, the ten-point average roughness Rz is 4.0 μm or less, and the area ratio of the pits 6 generated in the inner periphery 1*a* of the cylinder liner 1 is controlled to 8% or less.

The allowance for the finishing honing is set to about 1 to 3 μm.

EXAMPLES

While examples of the present invention will be exemplarily described below, the present invention is not limited to only the following examples.

Seven types of cylinder liners of Example 1 to Example 4 and Comparative examples 1 to 3 were fabricated in the following sequence.

A cylindrical flaky graphite cast iron cylinder liner material having a product inner diameter of 140 mm and a length of 280 mm was fabricated through centrifugal casting.

The cylinder liner material has a composition including C: 3.0%, Si: 2.1%, Mn: 0.75%, P: 0.3%, S: 0.06%, Cr: 0.5%, Cu: 0.3%, and Ni: 0.2%, in terms of mass % and constituted by the remainder Fe and inevitable impurities, and the hardness of material was an average value of 98HRB on the basis of JIS Z 2245: 2011.

Coarse grounding of removing black scales of the inner and outer peripheries was performed on these cylinder liner materials, and rough processing was performed on the inner periphery and the outer periphery. Next, the inner periphery and the outer periphery were processed to a state close to a desired dimension using an NC lathe or the like, and finishing on the outer periphery was terminated.

Next, regarding the first honing process and the second honing process, a honing process was divided into three types, and Comparative examples and Examples were assigned as shown in the following Table 1 and five pieces of each were prepared.

TABLE 1

| Type | Honing |
|---|---|
| I | First honing only |
| II-1 | First honing → second honing (grinding wheel one-stage expansion) |
| II-2 | First honing → second honing (grinding wheel two-stage expansion) |

Type I: Comparative example 1

Type II-1: Comparative Example 2

Type II-2: Comparative example 3 and Example 1 to Example 4

Honing conditions of a first honing process is the same for all Examples and Comparative examples.

In Comparative example 1, processing advances to a nitriding process without going through a second honing process.

In Comparative Example 2, the second honing process is performed with a second expansion grinding wheel only and advances to the nitriding process.

In Comparative example 3 and Examples 1 to 4, processing is performed by the first expansion grinding wheel and the second expansion grinding wheel with combination of different stroke numbers, and advances to the nitriding process.

The above is described in Table 2.

TABLE 2

| | | Second honing process | |
|---|---|---|---|
| | Honing process type | First expansion grinding wheel stroke number | Second expansion grinding wheel stroke number |
| Example 1 | II-2 | 60 | 40 |
| Example 2 | II-2 | 40 | 40 |
| Example 3 | II-2 | 20 | 40 |
| Example 4 | II-2 | 20 | 30 |
| Comparative example 1 | I | — | — |
| Comparative Example 2 | II-1 | 0 | 40 |
| Comparative example 3 | II-2 | 20 | 20 |

All of the five cylinder liner materials of Examples and Comparative examples after the second honing were accommodated in a dedicated nitriding furnace, and nitriding was performed at a fixed temperature of 590° C. for 40 minutes.

All of the cylinder liner materials taken out from the dedicated nitriding furnace after the nitriding were processed by the finishing honing process under the same honing conditions.

Table 3 shows average values of measurement data of a surface roughness of the inner periphery before and after nitriding, an area ratio of pits after finishing honing, a open graphite ratio, a compound layer thickness and a surface roughness of the cylinder liners in each example.

An area ratio of pits was evaluated as follows.

An area ratio of pits: 6% or less . . . A

An area ratio of pits: exceeding 6% and 8% or less . . . B

An area ratio of pits: exceeding 8% and 10% or less . . . C

An area ratio of pits: exceeding 10% . . . D

TABLE 3

| | Inner periphery roughness | | | After finishing honing | | | | | |
|---|---|---|---|---|---|---|---|---|---|
| | Before nitriding | | After nitriding | Area ratio | open graphite | Compound layer | Surface roughness | | Evaluation |
| | Rz [μm] | Rmax [μm] | Rz [μm] | of pit [%] | ratio [%] | thickness [μm] | Rz [μm] | Rmax [μm] | of area ratio of pit |
| Example 1 | 1.0 | 1.3 | 4.7 | 3.8 | 24 | 6 to 10 | 2.3 | 3.4 | A |
| Example 2 | 1.0 | 1.3 | 4.1 | 4.0 | 28 | 6 to 11 | 2.6 | 3.7 | A |
| Example 3 | 1.5 | 2.3 | 5.2 | 5.9 | 34 | 5 to 11 | 3.5 | 5.2 | A |
| Example 4 | 1.6 | 2.5 | 5.5 | 8.0 | 49 | 6 to 12 | 3.9 | 5.7 | B |
| Comparative example 1 | 2.4 | 2.8 | 8.4 | 12.1 | 74 | 5 to 11 | 4.3 | 5.9 | D |
| Comparative Example 2 | 2.0 | 2.2 | 6.5 | 10.2 | 68 | 6 to 11 | 4.1 | 6.0 | D |
| Comparative example 3 | 1.8 | 2.9 | 5.9 | 8.4 | 56 | 6 to 12 | 3.8 | 5.9 | C |

[Tests of Oil Consumption]

Tests of oil consumption of the cylinder liners of Example 3 and Comparative example 1 were performed.

As a result of the tests, it was found that, in the cylinder liner of Example 3, the oil consumption rate (g/PS·h) could be reduced by 43% compared to the cylinder liner of Comparative example 1.

INDUSTRIAL APPLICABILITY

According to the cylinder liner of the present invention, in addition to reduction in oil consumption and friction, the risk of scuffing can be reduced.

REFERENCE SIGNS LIST

1 . . . Cylinder liner
1*a* . . . Inner periphery
1*b* . . . Groove section
1*c* . . . Cross hatching section
2 . . . Cylinder block
2*a*, 2*b* . . . Fitting section
3 . . . Cast iron base
3*a* . . . Covering section
5 . . . Free graphite
5*a*, 5*b* . . . Part
5*d* . . . Exposed part
6 . . . Pit
7 . . . Compound layer

What is claimed is:

1. A cylinder liner mounted on a cylinder block and formed of flaky graphite cast iron, wherein at least a nitrided compound layer having a thickness of 3 μm or more and 15 μm or less is provided on an inner periphery of the cylinder liner, and a cross hatching section is formed on the inner periphery, a roughness curve of the inner periphery has a plateau honing shape in which mountain sections of the roughness curve are removed to form smooth mountain sections, a ten-point average roughness Rz of the inner periphery pursuant to JIS B0601:1982 is 4.0 μm or less, an average value of an area ratio of pits generated in the inner periphery is 8% or less, a depth of pits is equal to or smaller than the thickness of the nitrided compound layer, and a diameter of pits is 10 to 100 μm.

2. The cylinder liner according to claim 1, wherein the cylinder liner has a metal structure in which flaky free graphite is dispersed and crystallized in a cast iron matrix, some of the free graphite present in a surface part to a depth of 20 μm of the inner periphery of the cylinder liner is dispersed such that a part of some of the free graphite reaches to the inner periphery as an exposed part, and the other free graphite present in the surface part of the inner periphery extends to a vicinity of the inner periphery and is dispersed such that a part reaching the inner periphery from an extension part tip of the other free graphite is a covering section formed of a material that constitutes the cast iron matrix.

3. The cylinder liner according to claim 2, wherein, in the metal structure of the surface part of the inner periphery, the number of graphite flakes in which the free graphite is exposed on the inner periphery is referred to as a number of open graphite flakes, the number of graphite flakes in which the free graphite is not exposed on the inner periphery is referred to as a number of closed graphite flakes, the number of open graphite flakes and the number of closed graphite flakes are counted, and an average value of an open graphite ratio expressed by the number of open graphite flakes/(the number of open graphite flakes+the number of closed graphite flakes) is 50% or less.

4. The cylinder liner according to claim 1, wherein a groove of the cross hatching section is 3° to 60° of an angle opening in a direction perpendicular to an axial direction of the cylinder liner.

5. A method of manufacturing a cylinder liner, wherein a cylinder liner having a cylindrical shape and formed of flaky graphite cast iron is cast, a process in forming a cylinder liner inner periphery includes undergoing a first honing process of making an inner diameter of the inner periphery close to that for finishing after cutting, in a second honing process using a grinding wheel two-stage expansion method provided with a first expansion grinding wheel and a second expansion grinding wheel, a surface roughness of the inner periphery being made to have a ten-point average roughness Rz of 1.6 μm or less and a maximum height Rmax of 2.6 μm or less, and the cylinder liner in which the roughness curve of the inner periphery has a plateau honing shape in which mountain sections of the roughness curve are removed to form smooth mountain sections, the ten-point average roughness Rz of the inner periphery pursuant to JIS B0601:1982 is 4.0 μm or less, and an average value of an area ratio of pits generated in the inner periphery is 8% or less being obtained.

6. The method of manufacturing a cylinder liner according to claim 5, wherein the cylinder liner before nitriding has a metal structure in which free graphite is dispersed and crystallized in a cast iron matrix, some of the free graphite present on a surface part of the inner periphery of the cylinder liner is dispersed such that a part of some of the free graphite reaches to the inner periphery as an exposed part, the other free graphite present on the surface part of the inner periphery extends to a vicinity of the inner periphery and is dispersed such that a part reaching the inner periphery from an extension part tip of the other free graphite is a covering section covered with a material that constitutes the cast iron matrix, and in the metal structure of the surface part of the inner periphery, the number of graphite flakes in which the free graphite is exposed to the inner periphery is referred to as a number of open graphite flakes, the number of graphite flakes in which the free graphite is not exposed to the inner periphery is referred to as a number of closed graphite flakes, the number of open graphite flakes and the number of closed graphite flakes are counted, and an average value of an open graphite ratio expressed by the number of open graphite flakes/(the number of open graphite flakes+the number of closed graphite flakes) is 50% or less.

7. The method of manufacturing a cylinder liner according to claim 6, wherein the cylinder liner in which the surface part of the inner periphery is within a range of a depth of 20 μm from a surface of the inner periphery is obtained.

8. A cylinder liner mounted on a cylinder block and formed of flaky graphite cast iron, wherein at least a nitrided layer containing a nitrided compound layer is provided on an inner periphery of the cylinder liner, and a cross hatching section is formed on the inner periphery, a roughness curve of the inner periphery has a plateau honing shape in which mountain sections of the roughness curve are removed to form smooth mountain sections, a ten-point average roughness Rz of the inner periphery pursuant to JIS B0601:1982 is 4.0 μm or less, and an average value of an area ratio of pits generated in the inner periphery is 8% or less, and wherein the cylinder liner has a metal structure in which flaky free graphite is dispersed and crystallized in a cast iron matrix, some of the free graphite present in a surface part to a depth of 20 μm of the inner periphery of the cylinder liner is dispersed such that a part of some of the free graphite reaches to the inner periphery as an exposed part, and the other free graphite present in the surface part of the inner periphery extends to a vicinity of the inner periphery and is dispersed such that a part reaching the inner periphery from an extension part tip of the other free graphite is a covering section formed of a material that constitutes the cast iron matrix, and in the metal structure of the surface part of the inner periphery, the number of graphite flakes in which the free graphite is exposed on the inner periphery is referred to as a number of open graphite flakes, the number of graphite flakes in which the free graphite is not exposed on the inner periphery is referred to as a number of closed graphite flakes, the number of open graphite flakes and the number of closed graphite flakes are counted, and an average value of an open graphite ratio expressed by the number of open graphite flakes/(the number of open graphite flakes+the number of closed graphite flakes) is 50% or less.

9. The cylinder liner according to claim 1, wherein the area ratio of pits is 3.8% or more and 8.0% or less.

10. The cylinder liner according to claim 3, wherein the average value of the open graphite ratio is 24 to 49%, and the thickness of the nitrided compound layer is 6 to 12 μm.

11. The cylinder liner according to claim 2, wherein the area ratio of pits is 3.8% or more and 8.0% or less.

12. The cylinder liner according to claim 3, wherein the area ratio of pits is 3.8% or more and 8.0% or less.

13. The cylinder liner according to claim 8, wherein the area ratio of pits is 3.8% or more and 8.0% or less.

14. The cylinder liner according to claim 9, wherein the average value of the open graphite ratio is 24 to 49%, and the thickness of the nitrided compound layer is 6 to 12 μm.

15. The cylinder liner according to claim 2, wherein a groove of the cross hatching section is 3° to 60° of an angle opening in a direction perpendicular to an axial direction of the cylinder liner.

16. The cylinder liner according to claim 3, wherein a groove of the cross hatching section is 3° to 60° of an angle opening in a direction perpendicular to an axial direction of the cylinder liner.

17. The cylinder liner according to claim 8, wherein a groove of the cross hatching section is 3° to 60° of an angle opening in a direction perpendicular to an axial direction of the cylinder liner.

18. The cylinder liner according to claim 9, wherein a groove of the cross hatching section is 3° to 60° of an angle opening in a direction perpendicular to an axial direction of the cylinder liner.

19. The cylinder liner according to claim 10, wherein a groove of the cross hatching section is 3° to 60° of an angle opening in a direction perpendicular to an axial direction of the cylinder liner.

* * * * *